United States Patent [19]

Stoll et al.

[11] Patent Number: 4,724,685

[45] Date of Patent: Feb. 16, 1988

[54] FLAT-BED KNITTING MACHINE

[75] Inventors: Thomas Stoll; Ernst Goller, both of Reutlingen, Fed. Rep. of Germany

[73] Assignee: Supfina Machinenfabrik Hentzen GmbH & Co. KG, Fed. Rep. of Germany

[21] Appl. No.: 906,042

[22] Filed: Sep. 11, 1986

[30] Foreign Application Priority Data

Sep. 14, 1985 [DE] Fed. Rep. of Germany ..... 3532943

[51] Int. Cl.[4] ..... D04B 7/04

[52] U.S. Cl. ..... 66/64; 66/60 R

[58] Field of Search ..... 66/126, 127, 128, 129, 66/64, 78

[56] References Cited

U.S. PATENT DOCUMENTS

| | | | |
|---|---|---|---|
| 556,749 | 3/1896 | Herfurth | 66/126 R |
| 3,425,245 | 2/1969 | Essig | 66/64 R |
| 4,505,134 | 3/1985 | Essig | 66/64 R |
| 4,640,103 | 2/1987 | Schieber | 66/64 |

*Primary Examiner*—Ronald Feldbaum

*Attorney, Agent, or Firm*—Jones, Tullar & Cooper

[57] ABSTRACT

A flat-bed knitting machine is described, the needle bed apparatus of which has a front and back needle bed, each continuous and extending over a substantial portion of the machine length, and the carriage apparatus of which, having a stop-free cam system, is movable back and forth on or above the needle bed apparatus by means of a drive apparatus and is triggered by a program for various knitting patterns. The intent is with this kind of flat-bed knitting machine to enable more-productive knitting of two or more articles on the needle bed apparatus in one operation, by exploiting the needle bed space, and at the same time to use it for knitting only a single article on the needle bed apparatus. To this end, each carriage unit comprises at least two single- or multi-system carriages, in coupled drive, the spacing between which is adjustable and which can each be triggered independently of one another for various knitting patterns, and the drive apparatus for the carriage apparatus is embodied to be reversible.

10 Claims, 3 Drawing Figures

FLAT-BED KNITTING MACHINE

FIELD OF THE INVENTION

The present invention relates to a flat-bed knitting machine having a needle bed apparatus having a front and back needle bed, each of them continuous and extending over a substantial portion of the machine length, and a carriage apparatus with a stop-free cam system which is movable back and forth on or above the needle bed apparatus by means of a drive apparatus. The front and back carriage units are triggered in accordance with a program for various knitting patterns.

BACKGROUND OF THE INVENTION

In a known flat-bed knitting machines of this type, the front and back carriage unit of the carriage apparatus comprises a single, and in particular multi-system, carriage. On such flat-bed knitting machines, in order to exploit the full width of the needle bed apparatus, two or more identical knitted articles can be made side by side; however, the carriage executes one stroke over the entire length of the needle bed apparatus. Although this is an advantage in terms of utilization of the machine width, nevertheless it is not an optimal solution, because each knitted article itself has a considerably lesser width.

In other flat-bed knitting machines, it is also known to embody the drive apparatus for the carriage apparatus reversibly, so that the carriage stroke can be adjusted for the width of a given knitted article to be made on the needle bed apparatus; this has advantages in terms of time, if the width of the knitted article in substantially less than the length of the needle bed apparatus.

SUMMARY OF THE INVENTION

It is an object of the present invention to provide a flat-bed knitting machine of the above type which, by exploiting the needle bed space, enables more highly productive knitting of two or more articles on the needle bed apparatus in one operation and which at the same time can also be used for knitting only a single article on the needle bed apparatus.

This object is attained according to the invention by the provisions described herein.

With the provisions according to the invention, the front and back carriage unit can be used not only for making two or more knitted articles side by side on the needle bed apparatus, but also, in a simple manner, for making a single knitted article that substantially fills the needle bed apparatus in the usual way. By adjusting the spacing of the carriages, a conversion can be made in a simple manner from knitting one article to knitting two or more articles side by side. The size of the carriage stroke adjusts to the width of one of the knitted articles, which are preferably identical. Thus the flat-bed knitting machine can be used substantially more productively for making two or more knitted articles on the same needle bed apparatus, because the stroke decreases to one-half, one-third or less of the former stroke.

In the above-mentioned known flat-bed knitting machine, the reversible drive apparatus was achieved by means of a suitably shiftable gear. According to an exemplary embodiment of the present invention, the drive apparatus is provided with a reversible electric drive motor for this purpose.

To enable placing the two or more knitted articles that are to be made side by side on one needle bed apparatus as close together as possible, a preferred exemplary embodiment of the present invention provides that the needle space of the needle bed apparatus that is required for a particular knitted article and is passed over by the associated carriage is passed over, at least partway, by the carriage associated with the needle space for the adjacent knitted article. In other words, the spacing between two knitted articles that are to be made side by side can be selected without taking into account the width of the particular associated carriage, since during the return stroke of the carriage unit, the following carriage can move into the vicinity of the knitted article not associated with it.

In the flat-bed knitting machines discussed at the outset above, a yarn guide arrangement is generally provided, the yarn guides of which can be selectively picked up and carried along with and set down from the carriage unit depending upon which yarn is to be worked with at a particular time. According to an exemplary embodiment of the present invention, a plurality of yarn guides are associated with each carriage, which can be set down during a return phase of the carriage unit in the needle space of the adjacent knitting article not associated with them. This has the considerable advantage that it is no longer necessary to provide a distance between two knitted articles that are to be made side by side for setting down the yarn guides, and so this is a further reason why the knitted articles can be placed quite close together.

In order to provide this opportunity also for yarn guides of the type that are not needed after the reversal of the carriage unit, the carriage of the carriage unit in a further exemplary embodiment of the invention is provided with at least one auxiliary device, with which an unneeded yarn guide, after the carriage unit reversal, is carried along in a trailing manner out of the vicinity of the adjacent knitted article and into the vicinity of the associated knitted article, where it is set down, or following another reversal of the carriage unit the unneeded yarn guide is carried along out of the vicinity of the associated knitted article into the vicinity of the adjacent knitted article, again in a trailing manner, and there set down again.

According to the present invention, the carriages of the carriage unit are suitably replaceable on the needle bed apparatus, so that it is possible depending on the desired function to use carriages with different kinds of cam arrangement, depending on the pattern being knitted.

Further details and features of the invention will become apparent from the ensuing description of an exemplary embodiment, taken in conjunction with the drawings.

DESCRIPTION OF THE PREFERRED EMBODIMENT

Figure 1:
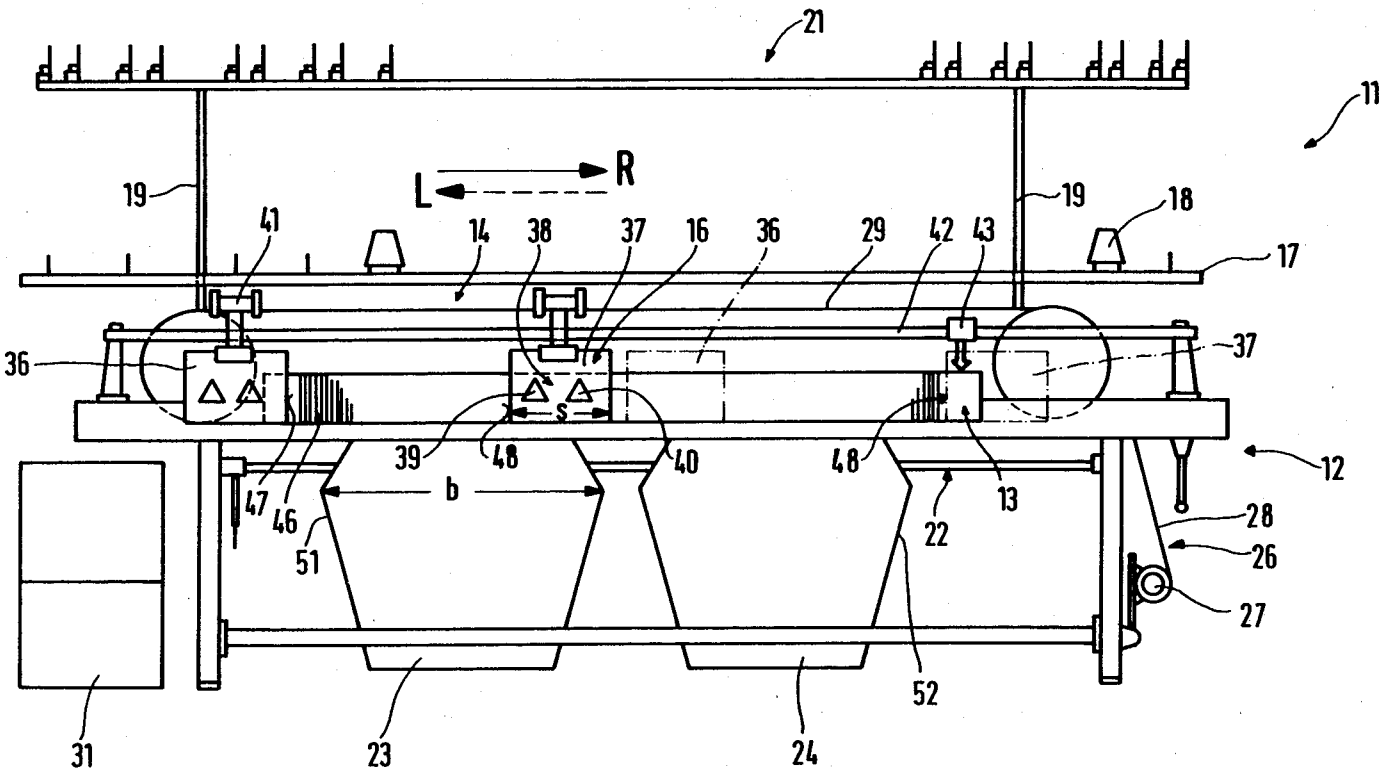
FIG. 1 is a schematic back view of a flat-bed knitting machine according to a preferred exemplary embodiment of the present invention, with two spaced-apart carriages of the front and back carriage unit for making two knitted articles suspended side by side.

The flat-bed knitting machine 11 shown in the drawing has a machine frame 12, on the front area of which a needle bed apparatus 13 is secured. A carriage apparatus 14, comprising front and back carriage units 16 passing over a front and back needle bed, is movable back and forth in the direction of the arrows R and L on the needle bed apparatus 13. The carriage units 16 are joined together such that they do not move relative to one another; only the back one of these carriage units is visible in the drawing. Above the needle bed and carriage apparatus 13, 14, a spool table 17 carrying yarn spools 18 is secured to the machine frame 12. By means of rods 19, a yarn guide arrangement 21 is retained on the machine frame 12 above the spool table 17. A goods removal device 22 for removing the knitted articles 23 and 24 shown is disposed in the vicinity of the machine frame 12 below the needle bed apparatus 13. Also in a lower region of the machine frame 12, but to the back and side, there is a drive apparatus 26 for the carriage apparatus 14, which is provided with a reversible electric motor 27 coupled in a driving manner with a horizontal chain drive 29 by means of a step-up gear 28; the carriage apparatus 14, that is, the front and back carriage unit 16, is coupled to or driven by the chain drive 29. On the end of the flat-bed knitting machine 11 remote from the drive apparatus 26, below the needle bed apparatus 13 and beside the machine frame 12, a control unit 31 is provided, which includes a data processing unit and input keyboard, with the aid of which the movement and pattern of the carriage apparatus 14 is triggered.

Since the front and back carriage units 16 of the carrage apparatus 14 are identical, it will suffice here to describe merely the back carriage unit 16. In the exemplary embodiment shown, the carriage unit 16 comprises two carriages 36 and 37, which are preferably identical in structure and which are provided with a cam system 38 made up of two identical cam units 39 and 40. It will be understood that the cam system 38 of the carriages 36, 37 may also have only one cam unit, or may have more than two cam units. The cam system 38 is a stop-free cam system; that is, it is for instance embodied as a suppressor cam system or as a cam system in which the cam elements are indexed electromagnetically. This does not affect the fact that the needle retractor elements are motor-adjustable in a known manner. The two carriages 36 and 37, like the front and back carriage units, are coupled with one another so that they do not move relative to one another. However, the two carriages 36, 37 of each carriage unit 16 are adjustable in terms of their spacing apart from one another. If the carriages 36, 37 are secured on the chain (not shown in detail) of the chain drive 29, then a change in the spacing of the carriages 36, 37 relative to one another can be effected for instance such that the carriages 36, 37 are each joined to a different link of the chain of the chain drive. It will be understood that suitable provisions may also be present to enable adjusting the spacing of the carriages 36, 37 in an infinitely graduated rather than incremented manner.

In a region above the apex of the V formed by the front and back needle beds facing one another on the needle bed apparatus 13, or by the facing carriage units of the carriage apparatus 14, but below a bracket-like connection 41 between the back and front carriage units 16, preferably a plurality of yarn guide rails 42 are secured side by side, extending parallel over the length of the flat-bed knitting machine 11, and a plurality of yarn guides 43 are secured on them such that they can slide back and forth. These yarn guides 43, only a few of which are shown in the drawing and the yarn take-up eye of which, in the immediate vicinity of the apex of the needle bed apparatus 13 or of the facing needles 46, serves to supply the yarn to the working needles 46, are selectively carried along by the carriage units 16 in a manner known per se and are set down prior to the carriage reversal and after the carriage reversal are either carried along or left standing. To this end, the carriage units 16 are provided with yarn guide carrying devices 61, 62 (FIG. 2) for selectively carrying the yarn guides 43 along and uncoupling them again.

Figure 2:
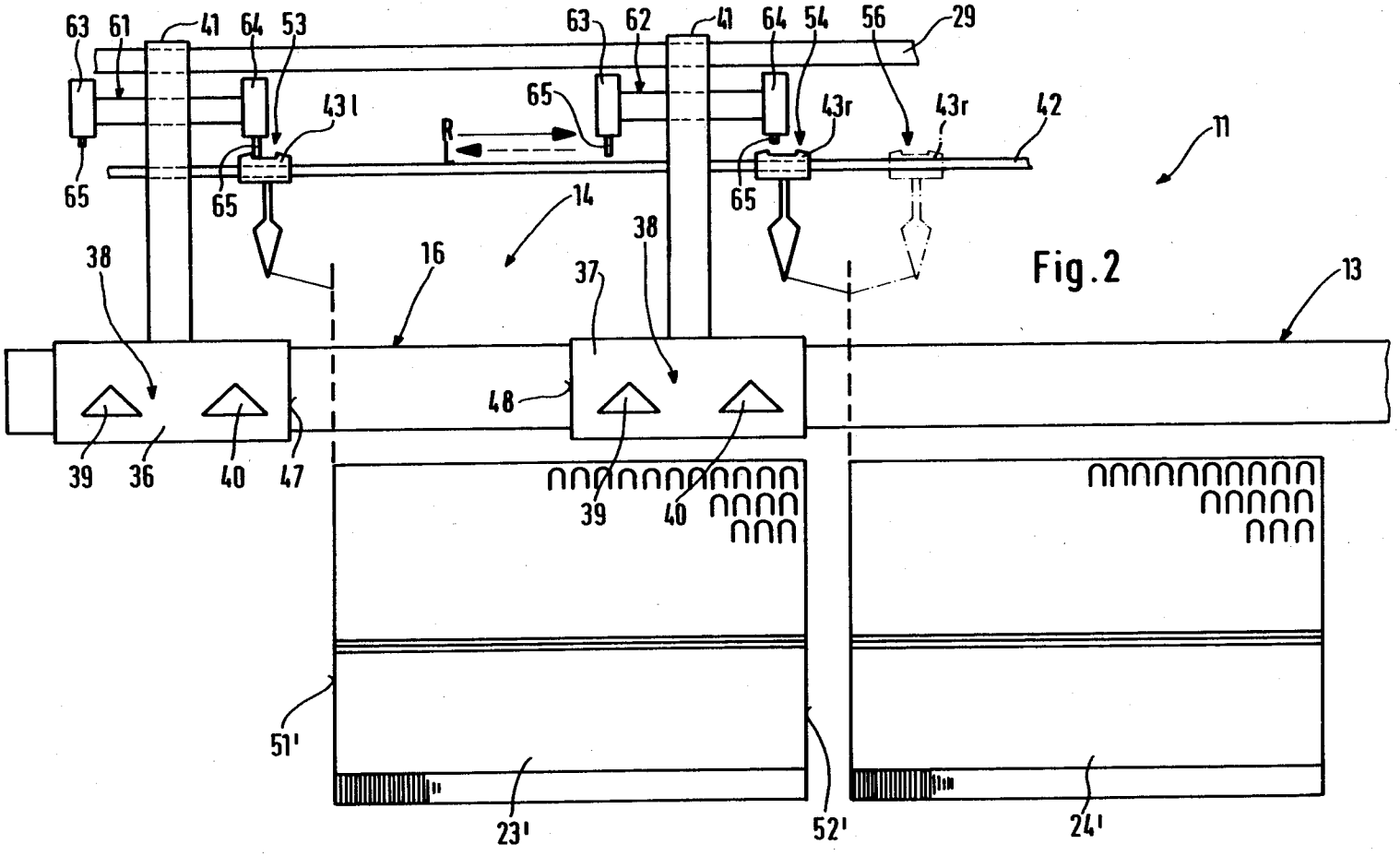
FIG. 2, illustrates on a larger scale, a detail of the arrangement of the carriages and the associated yarn guides relative to the knitted articles according to the exemplary embodiment of FIG. 1, but with knitted articles embodied somewhat differently.

As shown in FIGS. 1 and 2, the two carriages 36 and 37 of the carriage unit 16 are disposed spaced apart by a distance that is shorter than the width of each of the equally wide articles 23, 24 to be knitted. The stroke of the carriage unit 16 having the two carriages 36, 37 that is to be executed is at least equal to the width of one knitted article 23, 24 plus the width of one carriage 36 or 37, so that it is attained that the particular carriage 36, 37 has its trailing edge 47 or 48 at the particular carriage reversal point on the other side of the left or right edge 51, 52 of the knitted article 23, 24 associated with it.

Referring to FIG. 1, the process of knitting two articles 23, 24 that are parallel to one another and are to be made on a single needle bed apparatus 13 will now be described:

The carriage reversal position prior to a run of the carriage unit 16 in the direction of the arrow R is shown in solid lines. In this reversal position, the edge 47 of the carriage 36 that is trailing in the direction L is located on the other side of the outermost point of the left edge 51 of the article 23. The spacing between this trailing edge 47 and this outermost point of the edge 51 is equal to at least twice the distance between needles, so as to enable an offset of one of the two needle beds. The other carriage 37 of the carriage unit 16 is disposed partly or completely inside the needle space of the needle bed apparatus 13 that is associated with the article 23 not associated with that carriage. Prior to the movement in the direction of the arrow R, the electric motor 27 of the drive apparatus 26 is reversed into this direction of movement. During the run of the carriage unit 16 in the direction of the arrow R, the now-leading carriage 37 works on the knitted article 24 associated with it, while the now-trailing carriage 36 works on the article 23 on the left that is associated with it. Since the cam system 38 of each of the two carriages 36, 37 is triggered independently of one another by the control unit 31, it is correspondingly possible to work on separate articles 23, 24. After one carriage stroke, which is somewhat longer than the length of the maximum knitted article width b plus the carrage width s, the other (right-hand) carriage reversal position is attained, which is (partly) shown in dot-dash lines. In this position, the trailing edge 48 of the carriage 37 has traveled outward beyond the outermost point of the right edge 52 of the right-hand article 24, and the trailing carriage 36 is disposed in the needle space of the right-hand article 24 not associated with this carriage. After yet another change in direction of the electric motor 27 of the drive apparatus 26, a stroke movement in the opposite direction takes place, in the direction of the arrow L, during which movement direction once again each carriage 36 or 37 works on the respective article 23 or 24 associated with it. Because the carriage unit 16 can be disposed in its carriage reversal position in such a way that a respective carriage 36, 37 can be located in the vicinity of the article not associated with it, the width of the carriages 36, 37 does not need to be taken into account in setting the spacing between the adjacent articles 23, 24 to be knitted.

In the enlarged detail shown in FIG. 2, one yarn guide 43 each, from among the many associated with each carraige 36, 37, and the correspondingly associated yarn guide carrier devices 61, 62, of which each one has two carrier boxes 63, 64 disposed spaced apart and having indexable carrier pins 65, are shown. Independently of this, FIG. 2 shows two articles 23' and 24' to be knitted, which unlike the articles 23, 24 are provided with straight parallel edges and with specific patterns. As noted above, a plurality of yarn guides 43 is associated with each carriage 36, 37, and with the aid of the respective carrier boxes 63, 64 of the carrier device 61 or 62 of the carriage 36, 37 respectively associated with them, these yarn guides are carried along selectively during the knitting, then are disengaged prior to the carriage reversal and left standing, and after the carriage reversal they are selectively carried along again during the return course or, if they are not needed, are left standing. Each yarn guide 43 is carried along by the carriage 36 associated with it in the leading direction (that is, with the leading carrier box 63 in the direction L or the box 64 in the direction R). The so-called parking places where the yarn guides 43 are left standing during the reversal of the carriage unit 16 are shown at 53 and 54 in FIG. 2, in which only those parking places used during the carriage reversal from leftward to rightward travel (from the arrow L to the arrow R) are shown. The parking place 53 for the yarn guide 43*l* associated with the carriage 36 is located on the far side of the left-hand edge 51' of the article 23' in the usual manner. In contrast, the parking place 54 for the yarn guide 43*r* associated with the carriage 37 is located inside the needle space of the needle bed apparatus 13 associated with the adjacent article 23'. This is possible because the cam system 38 of the carriage 37 not associated with the article 23' does not work by program on the needles 46 associated with this article, so that the yarn of the yarn guide 43*r* cannot be engaged by the needles of this needle space.

The yarn guide 43*l* associated with the carriage 36 can be carried along, leading in the direction of movement R, by means of the carrier box 64 of the device 61, as shown, or left standing at the parking place 53. To carry along the yarn guide 43*r* associated with the carriage 37 in the direction of movement R is not problematic and would be done in a leading manner, by means of the carrier box 64 of the device 62. On the other hand, if this yarn guide 43*r* associated with the carriage 37 is not needed in the direction of movement R, then it cannot be left standing at this parking place 54 in the vicinity of the non-associated adjacent article 23' but must instead be carried along to a shunt parking place 56, in a trailing manner. This shunt parking place 56 is located in a region of the associated needle space for the article 24'. To this end, a trailing auxiliary yarn guide carrier box, in the form of the carrier box 63 of the device 62, is associated with the carriage 37, carrying the yarn guide 43*r* along in a trailing manner from the parking place 54 to the shunt parking place 56, shown in dot-dash lines, and then disengages it. Once knitting in the direction of movement R is completed, the leading yarn carrier 43*l* carried along by the carriage 36 is set down in the vicinity of the non-associated article 24' at a parking place which may be identical to the shunt parking place 56 or located near it. When work in the direction of movement L begins again, the same procedure begins over again, and the yarn guide 43*r* previously left standing at the shunt parking place 56 is carried along in a trailing manner by the associated carriage 37 by means of the carrier box 64 of the device 62 and carried to the original parking place 54 in the vicinity of the non-associated adjacent article 23'. In this manner, the distance between the two adjacent articles 23', 24' to be knited may be selected to be as close as possible, regardless of any parking places needed for the yarn guides 43.

It will be understood that the carriages 36, 37 of the carriage units 16 are adjusted in terms of their spacing for wider or narrower articles 23, 24 or 23', 24'.

It will also be understood that the carriage units 16 of the carriage apparatus 14 can also be divided up into more than two carriages, for instance having three, four or more carriages instead, so as to be able to knit more than two—that is, three, four or more—preferably identical articles side by side on one and the same needle bed apparatus 13. The spacing of the individual carriages from one another is selected as a function of the width of the article to be knitted and of the resultant stroke length, which intrinsically becomes substantially shorter, the more articles are to be knitted parallel to one another. Here again, carriages with multiple cam systems can be used. Nor is there any change in the carrying along and setting down of yarn guides or in the reversibility of the drive.

In this respect, it is significant that the carriage apparatus 14 or the individual carriages 36, 37 are embodied such that they can be replaced with others as simply as possible. This may be done for instance in that after disengagement from the drive and cutting off the yarn supply and similar manipulations, the no-longer-needed carriages are moved laterally out of the needle bed apparatus 13 and taken to a storage table, while by means of a different storage table other carriages are moved onto the needle bed apparatus 13. In this manner, an expansion from two to more than two carriages in one carriage unit can be made, and the type of carriage, in terms of the cam system, can also be changed.

Figure 3:
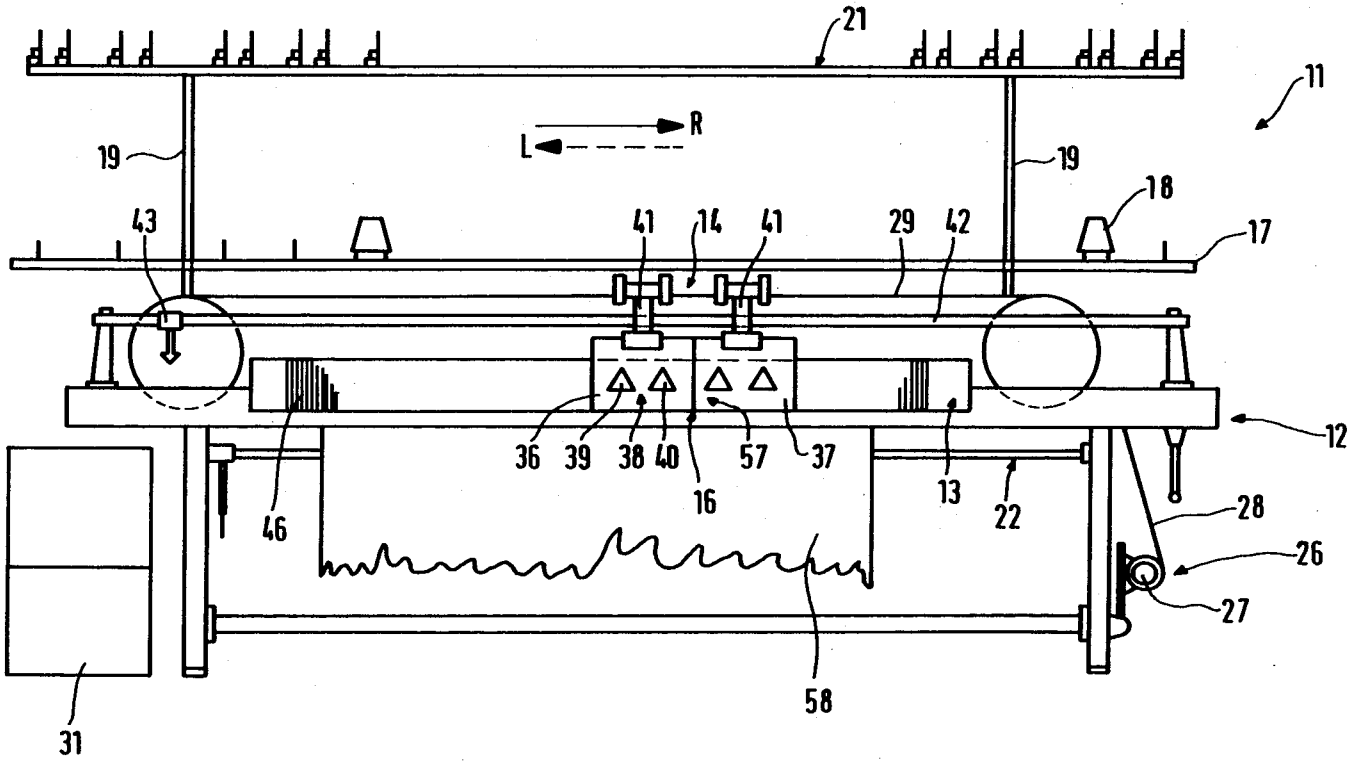
FIG. 3 is a schematic back view similar to FIG. 1, but with carriages abutting one another directly, for knitting a single article.

According to FIG. 3, the two carriages 36 and 37 of the carriage units 16 according to FIG. 1 are shifted in such a way that they rest immediately adjacent one another; that is, they are not spaced apart from one another. In this manner, the two carriages 36, 37 are coupled together to make a single, multi-system carriage element 57, with the aid of which a single knitted article 58 can be made, having a width that can be substantially equal to the length of the needle bed apparatus 13. This assures that both a single article 58 and a plurality of narrower articles 23, 24 or 23', 24' can be knitted on the flat-bed knitting machine 11 according to the invention, exploiting the width of the needle bed apparatus 13 and using various carriage units 16 having a varying number and arrangement of carriages.

What is claimed is:

1. A flat-bed knitting machine comprising:

a needle bed apparatus having a front and back needle bed each extending continuously over a substantial portion of the machine length;

a carriage apparatus having front and back carriage units each with at least two carriages and a stop-free cam system, movable relative to the needle bed apparatus; and reversible drive means connected to the carriage units for effecting movement of the carriage units in accordance with a program for various knitting patterns, wherein:

the carriage units are driven by the reversible drive means in a coupled manner; and the carriages of each carriage unit are independently triggered for various knitting patterns, and the spacing between them adjustable.

2. The flat-bed knitting machine as defined in claim 1, further wherein:

each carriage unit comprises two single system carriages.

3. The flat-bed knitting machine as defined in claim 1, further wherein:

each carriage unit comprises multiple system carriages.

4. The flat-bed knitting machine as defined in claim 1, further wherein:

the reversible drive means includes a reversible electric drive motor.

5. The flat-bed knitting machine as defined in claim 1, further wherein:

the needle space of the needle bed apparatus required for particular adjacent knitted articles is such that the space associated with each knitted article is traversed by an associated carriage and at least partly traversed by the carriage associated with the adjacent knitted article.

6. The flat-bed knitting machine as defined in claim 1, further comprising:

a plurality of yarn guides associated with each carriage such that during a reversal phase of a carriage unit the guides associated with the carriages thereof can be set down in the needle space of the adjacent and non-associated knitted article.

7. The flat-bed knitting machine as defined in claim 6, further comprising:

at least one yarn guide carrier device associated with each carriage which serves, after the reversal of the carriage unit, to carry an unneeded yarn guide along in a trailing manner out of the vicinity of the adjacent knitted article into the vicinity of the associated knitted article and set down there, or after a further reversal of the carriage unit to carry the unneeded yarn guide along in a trailing manner out of the vicinity of the adjacent article and set down there.

8. The flat-bed knitting machine as defined in claim 1, further wherein:

the carriages of the carriage units are replaceable.

9. The flat-bed knitting machine as defined in claim 1, further wherein:

the carriages of the carriage units can be coupled together at least in part to define a unitary multi-system carriage element.

10. A flat-bed knitting machine comprising:

a needle bed apparatus having a front and back needle bed each extending continuously over a substantial portion of the machine length;

a carriage apparatus having front and back carriage units each with at least two carriages and a stop-free cam system, movable relative to the needle bed apparatus;

reversible drive means connected to the carriage units for effecting movement of the carriage units in accordance with a program for various knitting patterns, wherein:

the carriage units are driven by the reversible drive means in a coupled manner; and the carriages of each carriage unit are independently triggered for various knitting patterns, and the spacing between them adjustable; and at least one yarn guide carrier device associated with each carriage which serves, after the reversal of the carriage unit, to carry an unneeded yarn guide along in a trailing manner out of the vicinity of the adjacent knitted article into the vicinity of the associated knitted article and set down there, or after a further reversal of the carriage unit to carry the unneeded yarn guide along in a trailing manner out of the vicinity of the adjacent article and set down there.

* * * * *

UNITED STATES PATENT AND TRADEMARK OFFICE

CERTIFICATE OF CORRECTION

PATENT NO. : 4,724,685

DATED : February 16, 1988

INVENTOR(S) : THOMAS STOLL AND ERNST GOLLER

It is certified that error appears in the above-identified patent and that said Letters Patent is hereby corrected as shown below:

Item [73] Assignee: Supfina Machinenfabrik Hentzen GmbH & Co. KG, Federal Republic of GERMANY should read: H. Stoll GmbH & Co., Federal Republic of GERMANY

Signed and Sealed this

Nineteenth Day of July, 1988

*Attest:*

*Attesting Officer*

DONALD J. QUIGG

*Commissioner of Patents and Trademarks*